US009139315B2

(12) United States Patent
LaTrobe

(10) Patent No.: US 9,139,315 B2
(45) **Date of Patent: *Sep. 22, 2015**

(54) AUTHENTICATION, SECURITY AND/OR MARKETING DISPLAY KIT FOR A PRECIOUS GEM AND METHOD

(71) Applicant: Christopher W. LaTrobe, Chicago, IL (US)

(72) Inventor: Christopher W. LaTrobe, Chicago, IL (US)

(73) Assignee: S. A. Gems Distributors Inc., Chicago, IL (US)

( * ) Notice: Subject to any disclaimer, the term of this patent is extended or adjusted under 35 U.S.C. 154(b) by 295 days.

This patent is subject to a terminal disclaimer.

(21) Appl. No.: 13/737,714

(22) Filed: Jan. 9, 2013

(65) Prior Publication Data

US 2013/0192172 A1 Aug. 1, 2013

Related U.S. Application Data

(63) Continuation of application No. 12/971,366, filed on Dec. 17, 2010, now Pat. No. 8,371,439.

(60) Provisional application No. 61/284,438, filed on Dec. 18, 2009.

(51) Int. Cl.

| | |
|---|---|
| ***G06Q 30/00*** | (2012.01) |
| ***B65B 5/10*** | (2006.01) |
| ***A47F 5/11*** | (2006.01) |
| ***A47F 7/024*** | (2006.01) |
| ***A47F 7/03*** | (2006.01) |
| ***B65D 5/42*** | (2006.01) |

(52) U.S. Cl.

CPC . *B65B 5/10* (2013.01); *A47F 5/112* (2013.01); *A47F 7/024* (2013.01); *A47F 7/03* (2013.01); *B65D 5/422* (2013.01); *B65D 5/4204* (2013.01)

(58) Field of Classification Search

CPC combination set(s) only.

See application file for complete search history.

(56) References Cited

U.S. PATENT DOCUMENTS

| | | | | |
|---|---|---|---|---|
| 4,111,413 | A | 9/1978 | Marcus | |
| 4,448,321 | A * | 5/1984 | Hanlet | 220/4.01 |
| 5,033,774 | A * | 7/1991 | Benardelli | 283/108 |
| 6,193,057 | B1 | 2/2001 | Cappiello, Sr. | |
| 6,267,230 | B1 | 7/2001 | Ovadia | |
| 7,883,000 | B2 * | 2/2011 | Sheffield et al. | 229/117.16 |

(Continued)

OTHER PUBLICATIONS

"New GIA Diamond Sealing Service", published Nov. 4, 2009 by Southern Jewelry News.*

(Continued)

*Primary Examiner* — Luna Champagne

(74) *Attorney, Agent, or Firm* — McCracken & Gillen LLC

(57) ABSTRACT

A new system of packaging and offering precious gems for sale are disclosed. A precious gem and an abbreviated certificate of authenticity about that gem are sealed within an at least partly see-through security case. The sealed security case is secured inside of an enclosed compartment in a security carton, and the gem and the abbreviated certificate of authenticity are visible through one or more windows in the security carton. Additional information about the gem is stored in a storage compartment in the security carton, which is separately accessible from the enclosed compartment. A retailer displays and offers the gem for sale directly to end consumers in the display package, and the consumer is assured by the display package that the gem has the characteristics disclosed on the abbreviated certificate of authenticity without requiring an intermediate local jeweler to verify the characteristics.

19 Claims, 8 Drawing Sheets

(56) References Cited

U.S. PATENT DOCUMENTS

| | | | | |
|---|---|---|---|---|
| 2002/0096441 | A1 | 7/2002 | Simpson | |
| 2004/0050720 | A1 | 3/2004 | Harris | |
| 2006/0047585 | A1* | 3/2006 | Lapa et al. | 705/27 |
| 2006/0201827 | A1 | 9/2006 | Herzog | |
| 2007/0045130 | A1 | 3/2007 | Kim | |
| 2007/0045131 | A1 | 3/2007 | Kim | |
| 2009/0199516 | A1 | 8/2009 | Gustavsson | |
| 2009/0234754 | A1* | 9/2009 | Lapa et al. | 705/27 |
| 2009/0302098 | A1 | 12/2009 | Learn | |

OTHER PUBLICATIONS

Certiline Srl, "The CertiCard Idea", [online] [retrieved on Dec. 20, 2010], retrieved from <http://www.certiline.com/certicards.htm>, 4 pages.

Certiline Srl product information page, "About Certiline . . . . ," undated, Certiline Srl, Varese, Italy, 1 page.

Certiline Srl product information page, "Certicard® the Best to hold the Best, The Unique AntiCounterfeiting Security Package for Your Precios Contents", Copyright 2009, Certiline Srl, Varese, Italy, 1 page.

Certiline Srl product information page, "Certiline, TP1—Manual Thermopress for One Single CertiCard®", Copyright 2009, Certiline Srl, Varese, Italy, 1 page.

Certiline Srl product information page, "Certiline, TP2—Semi Automatic Thermopress for CertiCard®", Copyright 2009, Certiline Srl. Varese, Italy, 1 page.

Press release article dated Aug. 6, 2009, entitled "New GIA Sealing Service for Diamonds", [retrieved on Dec. 20, 2010], retrieved from <http://www.gia.edu/nav/toolbar/newsroom/news-releases/2009news-releases/gia-sealing-service-for-diamonds.html>, 2 pages.

Stuller, "Red Box Diamonds®", [online] [retrieved on Dec. 20, 2010], retrieved from <http://www.stuller.com/pages/52/?id=52>, Copyright 2010,1 page.

* cited by examiner

AUTHENTICATION, SECURITY AND/OR MARKETING DISPLAY KIT FOR A PRECIOUS GEM AND METHOD

CROSS-REFERENCE TO RELATED APPLICATIONS

The present application claims the benefit of U.S. patent application Ser. No. 12/971,366, filed Dec. 17, 2010, which claims the benefit of Provisional U.S. Patent Application No. 61/284,438, filed Dec. 18, 2009, both of which are incorporated herein by reference in their entireties.

BACKGROUND

In the past, diamonds and other precious gems were purchased by an end consumer from an independent jeweler retailer, such as at his or her local jeweler. The consumer trusted the jeweler to verify that the diamond had certain quality characteristics. Often, the jeweler would have already sent the diamond to a third party certifying authority, such as the Gemological Institute of America Inc. ("GIA"), which would certify that the diamond had certain quality characteristics, and would return the diamond to the jeweler with a certificate. Although the diamond and the certificate were sent together to the jeweler, the consumer had to trust the jeweler that the diamond to which the consumer actually took possession, actually matched the certificate from the certifying authority.

More recently, on-line diamond vendors effectively cut out the independent jeweler by convincing consumers that they can buy a diamond without the services of a local jeweler so long as the consumer buys a "certified" diamond. The reality is a little different. No grading laboratory will guarantee that the diamond that the consumer receives is actually the same one that they certified; and current safeguards, when they are implemented, are easily manipulated. When currently purchasing on-line, the consumer unknowingly is assuming a large risk. Consumers are already apprehensive, which is why they want a jeweler to validate their purchase. Helping secure the customer's investment addresses this problem, and is an extremely valuable benefit as fraud and misrepresentation are a real and growing concern.

In one card-based security system that has been developed, a jeweler or online retailer sends a precious gem, such as a diamond, to a recognized certifying authority. The certifying authority examines the precious gem for certain characteristics, certifies that the precious gem has certain characteristics, such as carat weight, cut, clarity, color, etc., and produces a printed certificate documenting the same. In addition, the certifying authority may also engrave the precious gem with an identification number and include that identification number on the certificate. The certifying authority then seals both the gem and an abbreviated certificate together into a small sealed security case in such manner that both the precious stone and at least some of the printed information about the characteristics on the certificate are visible to a potential purchaser. The security case generally has the form of two clear plastic compartments that are sealed by lamination or similar technique to a small plastic card. The security case includes a UV seal that helps verify the integrity of the sealed security case and helps prevent fraud. In this manner, the purchaser is assured that the precious gem has certain characteristics because he or she sees both the gem and certificate and knows that the two have been sealed together by the certifying authority without requiring validation by a separate independent jeweler. One example of such a system is the card-based security systems offered by Certiline Srl, of 21050 Cantello-Varese, Italy, Via Varese, 29, and shown in FIGS. 1 and 2.

Although the card-based security system helps assure the purchaser of the quality of the diamond, its benefits with regard to branding, display, and direct-to-consumer marketing is relatively limited due to its basic design. Further, the card-based security system does not provide a convenient way to store the complete certificate from the certifying authority and the precious gem within the sealed security case. The present inventor has attempted to improve upon this system to provide additional benefits not heretofore contemplated in the jewelry retail business.

SUMMARY OF THE INVENTION

According to another embodiment of the invention, a method of packaging a precious gem is disclosed. The method includes the steps of having a certain characteristic about the precious gem certified as true, having the precious gem and an abbreviated certificate that identifies the certain characteristic enclosed together within a sealed security case, wherein the precious gem and the abbreviated certificate are viewable through the sealed security case, and enclosing the sealed security case and additional information regarding the precious gem together within a tamper-evident compartment of a display container. Preferably, the precious gem and the abbreviated certificate are visible outside of the display container, and the additional information is accessible for viewing while the sealed security case is enclosed in the tamper-evident compartment.

These and other aspects of the invention will become more apparent in view of the following detailed description and drawings.

DETAILED DESCRIPTION

Figure 1:
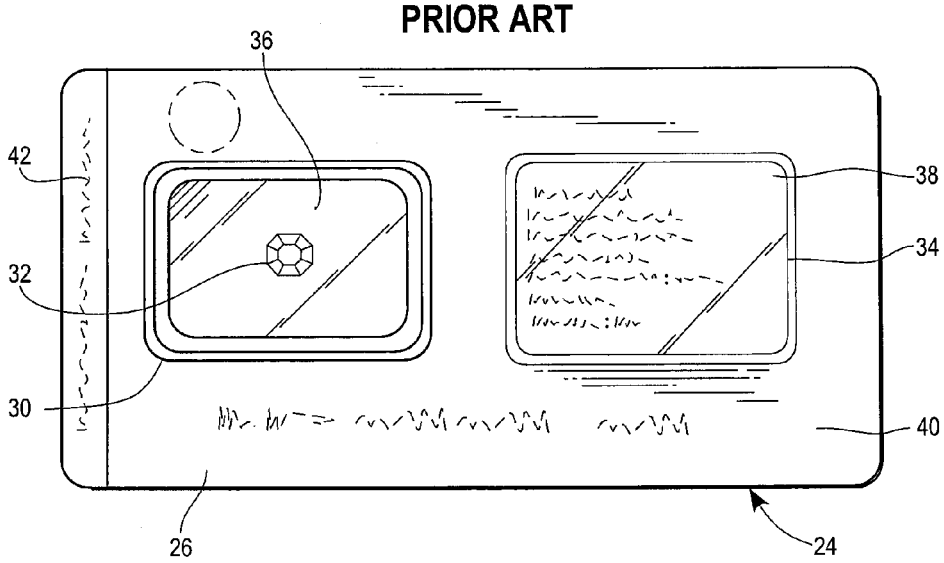
FIG. 1 PRIOR ART
FIGS. 1 and 2 show front and back views of a sealed diamond security case according to the prior art.

While the present invention is susceptible of embodiments in various forms, there are shown in the drawings and will hereinafter be described some exemplary and non-limiting embodiments, with the understanding that the present disclosure is to be considered an exemplification for the invention and is not intended to limit the invention to the specific embodiments illustrated and described in detail.

Turning now to the drawings, in one preferred form of the invention, a diamond security kit 20 and method are shown and described with reference to FIGS. 1-11. Although the preferred embodiments shown and described herein relate specifically to a diamond, the present invention may be used for any type of precious gem and even for other types of precious items, wherein each item has unique characteristics that may need to be certified to a potential purchaser, such as rare coins, stamps, antiques, jewelry, and the like.

As shown in FIGS. 7-11, one aspect of the invention is a security display carton 22. During use, the carton 22 sells the product to the consumer without requiring a sales associate, it protects the integrity of the product, guarding against tampering and damage, and it makes the entire purchase transaction quick and easy. In some embodiments, the present invention can guarantee the diamond, taking full responsibility for the authenticity of the diamond and its accompanying certificate (s).

Figure 2:
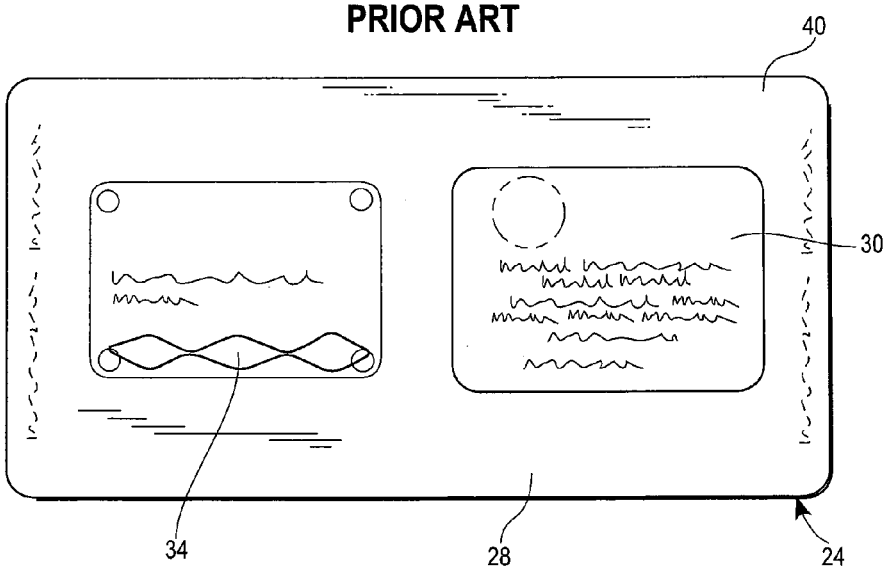
FIG. 2 PRIOR ART

Every diamond is sent to GIA for testing and certification and it is then sealed within a protective security case 24, as shown in FIGS. 1 and 2. The sealed security case 24 in the form of a laminated card-type system has a front side 26 and a back side 28. The front side 26 includes an enclosure system 30. A diamond 32 is sealed within the enclosure system 30. An abbreviated certificate of authenticity 34 is also sealed within the enclosure system 30. The abbreviated certificate of authenticity 34 includes printed thereon a variety of different information about the diamond 32 including, but not limited to, the unique GIA identification number of the diamond, date of certification, shape, carat weight, color, and clarity. Of course other information can also be provided on the abbreviated certificate of authenticity 34. Each of the diamond 32 and the abbreviated certificate of authenticity 34 is sealed within the enclosure system 30 under clear see-through windows, such as plastic capsules 36, 38, laminated to a stiff backing card 40. Various security measures are employed to maintain the security of the diamond 32 and the abbreviated certificate of authenticity 34 in the sealed security case 24, such as a UV seal 42 and/or other tamper-evident packaging. Further, the diamond 32 preferably has a unique GIA identification code (not shown) engraved thereon.

Figure 3A:
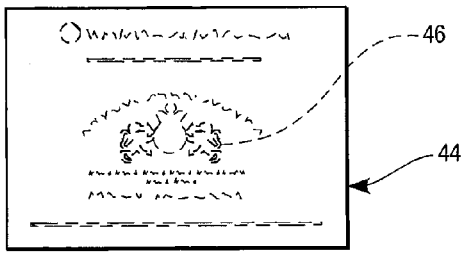
FIGS. 3A, 3B, and 3C show various views of an owner's manual for the diamond of FIGS. 1 and 2.
Figure 3B:
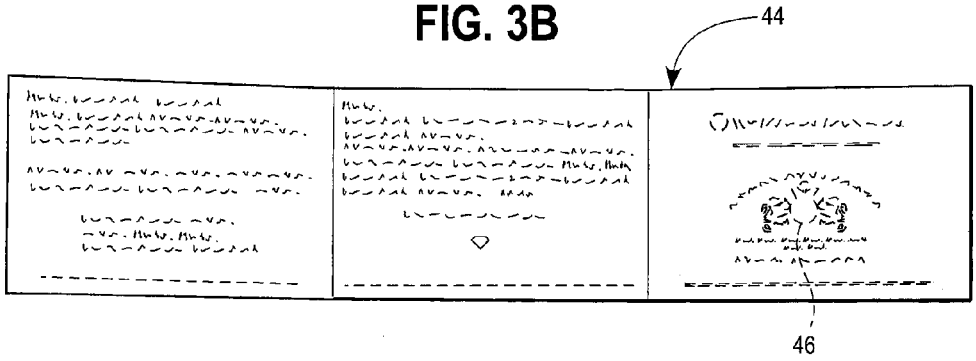
Figure 3C:
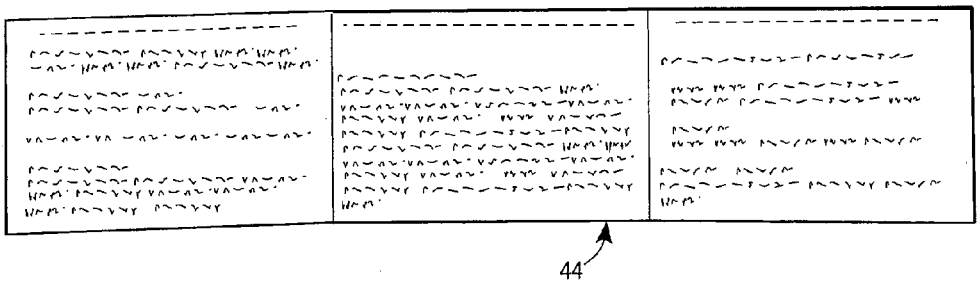

FIGS. 3A, 3B, and 3C show one example of an owner's manual 44, including various information important for the ownership experience. The owner's manual 44 preferably includes a brand marking 46, such as a trademark, that identifies the retailer who is offering the diamond for sale to the end consumer. The owner's manual 44 also may include information and instructions to the purchaser on how to ensure that the diamond 32 actually matches the information on the abbreviated certificate of authenticity 34 and other instructions for ensuring that the purchase is satisfactory.

Figure 4:
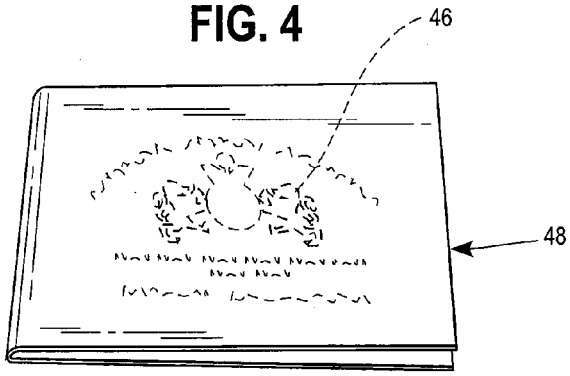
FIGS. 4 and 5 show open and closed views of a registry wallet of the invention.
Figure 5:
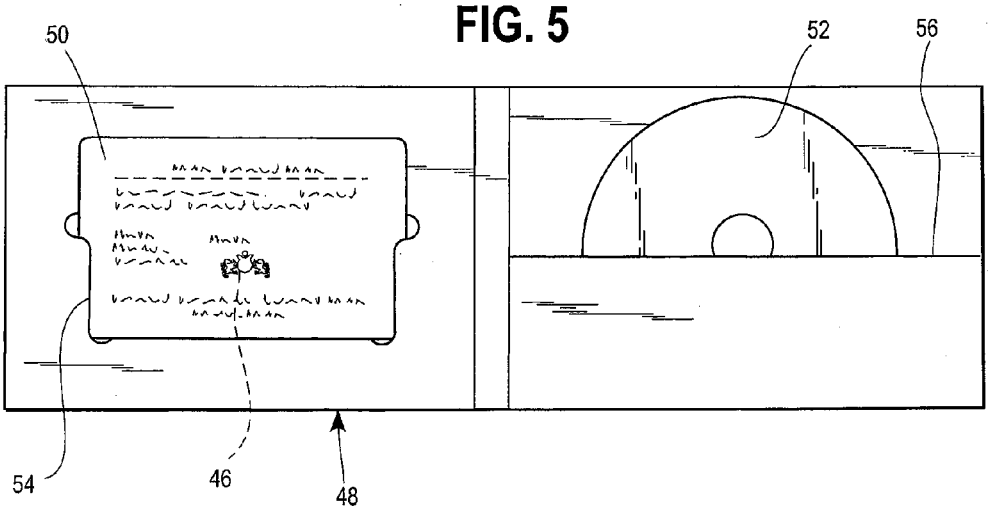

FIG. 4 shows a fold-open registry wallet 48 in a folded closed position, and FIG. 5 shows an interior of the registry wallet 48 in a folded open position containing a diamond registry card 50 and a CD-ROM 52 in respective pockets 54, 56. The registry card 50 includes information specific to the diamond 32, such as the carat weight, shape, and any inscription printed on the diamond. The CD-ROM 52 may include any sort of information relevant to the diamond 32 and/or purchasing experience, including general information and/or information unique to the diamond 32. Again, the brand marking 46 is preferably printed on each of the registry wallet 48, the diamond registry card 50, and the CD-ROM 52.

Figure 6A:
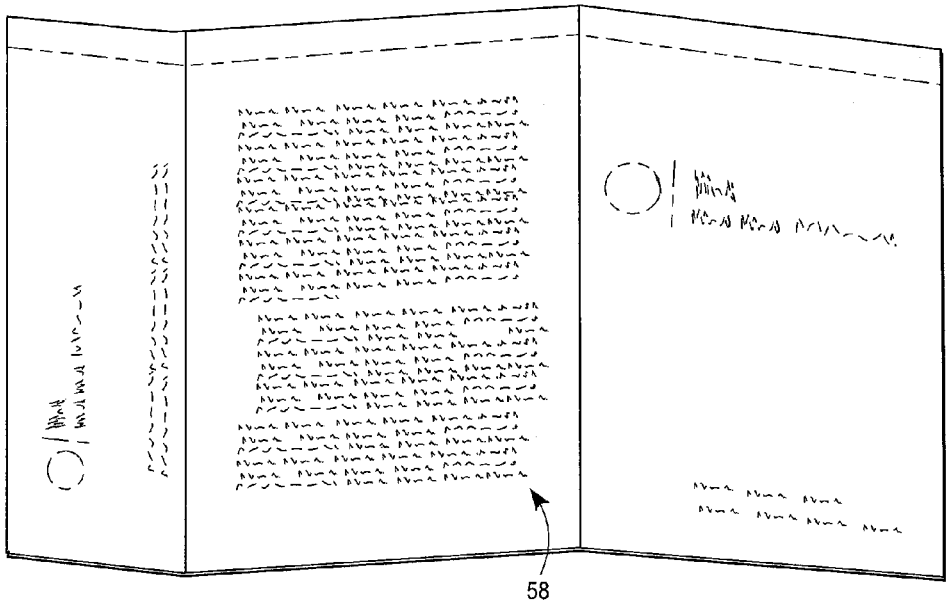
FIGS. 6A and 6B show additional information in the form of a complete diamond grading report for the diamond of FIGS. 1 and 2.
Figure 6B:
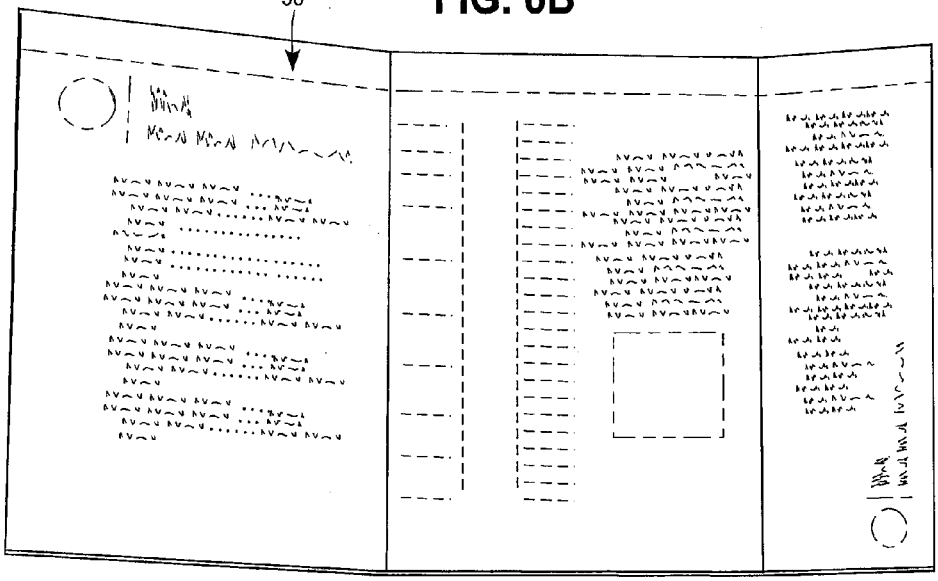

FIGS. 6A and 6B show front and back sides of a complete GIA diamond grading report 58. GIA is just one example of a well recognized certifying authority that certifies various characteristics of a unique precious item. Other recognized certifying authorities and certifying information desired for diamonds or as desired and/or appropriate for different types of unique precious items are also contemplated herein. The GIA diamond grading report 58 includes printed thereon a complete recital of characteristics of the diamond 32 that have been inspected and are certified by GIA in a manner well known in the art.

FIGS. 7-11 show the security display carton 22, which is used in connection with the diamond security kit 20 and methods described herein. In one form, the security display carton 22 has the form of a cardboard or plastic box with a fold-open cover 60, windows in the form of an opening 62, an opening 64 through a front panel of the fold-open cover 60, and a fold-out panel system 66 extending from the front panel of the fold-open cover 60. The fold-out panel system 66 includes a first section 68 adjacent the front panel of the fold-open cover 60, a second section 70 adjacent the first section 68, and a third section 72 adjacent the second section 70. The fold-out panel system 66 folds at fold line 74 to form a back panel of the fold-open cover 60. Adhesive sections 76 allow the fold-out panel system 66 to be sealed to the front panel of the fold-open cover 60, and perforated or frangible tear lines 78 around the second section 70 define a tearaway access panel that opens into a compartment 80 defined between the second section 70 and the openings 62 and 64. The security display carton 22 further includes a primary body container 82 portion of the box, and a storage area 84 defined within the primary body container 82. The fold-open cover 60 is attached to a side edge of the primary body container 82 and folds open and shut to expose or enclose the storage area 84. Preferably, the brand marking 46 is printed on the security display carton 22.

The diamond 32 preferably has a security code engraved thereon whereby the security code corresponds with the GIA numbering code to guarantee the authenticity of the diamond 32 and its specified GIA characteristics. The engraved security code guarantees that the GIA information supplied is linked to the specific diamond 32. The security code is also shown on the abbreviated certificate of authenticity 34 and on the GIA diamond grading report 58. Further, the brand marking 46 may also be engraved on the diamond 32 in order to further associate the brand of the retailer with the diamond.

Figure 9:
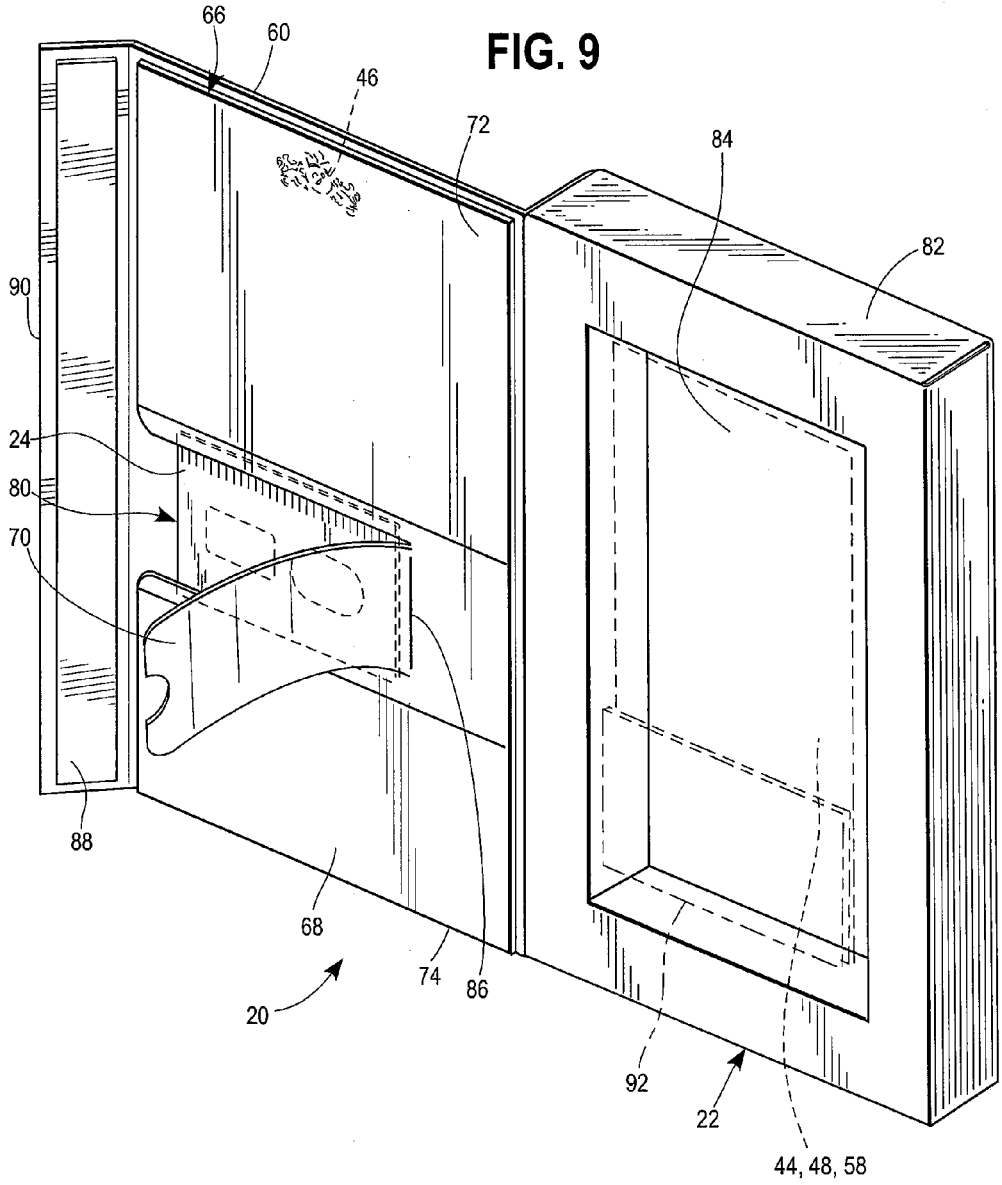
FIG. 9 is a front isometric view of the display carton of FIGS. 7 and 8 in an open position exposing the interior thereof.
Figure 10:
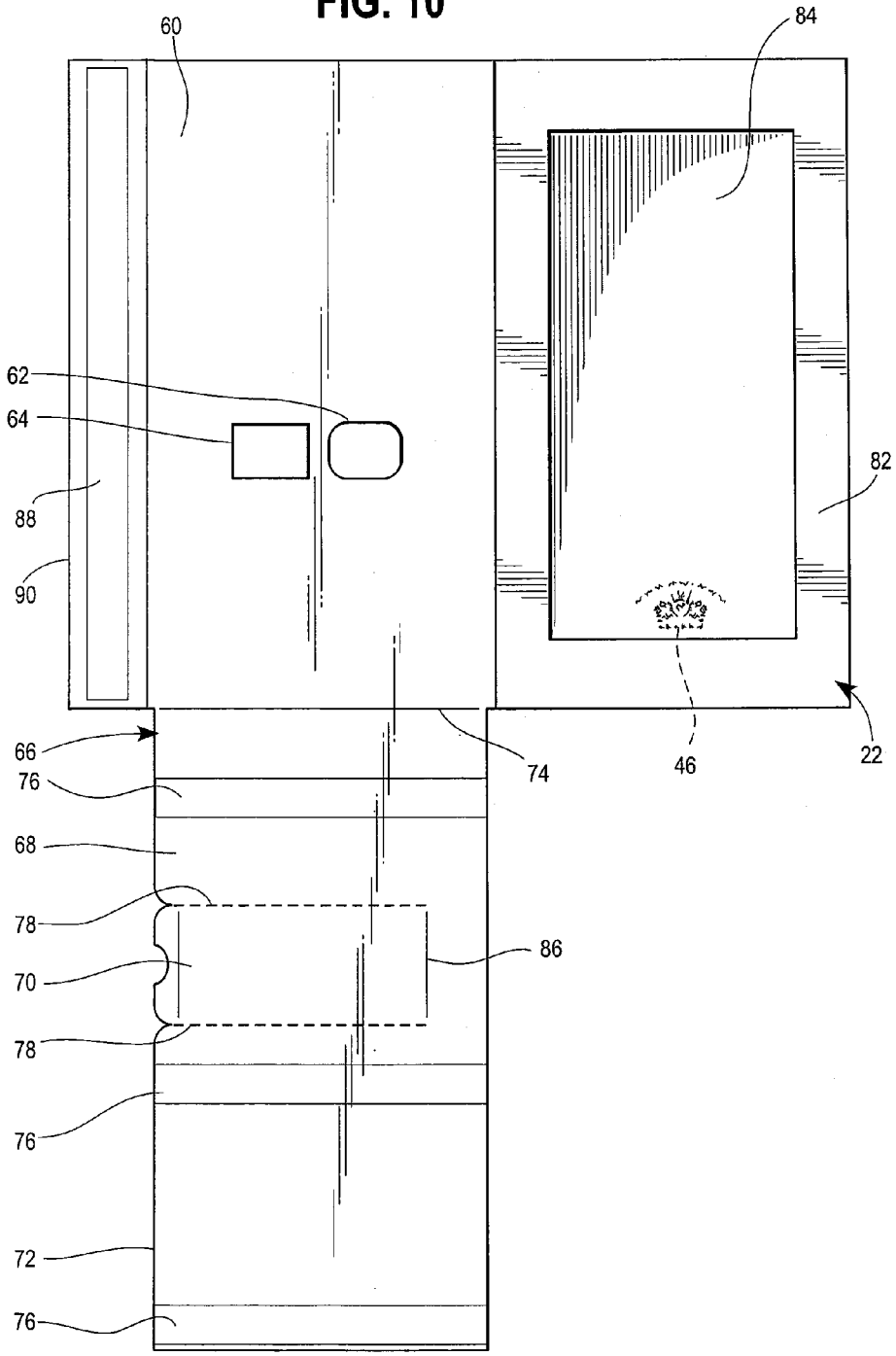
FIGS. 10 and 11 are front and back views of the display carton in an open position and with an inner wall that defines an enclosed compartment unfolded in an unassembled position.
Figure 11:
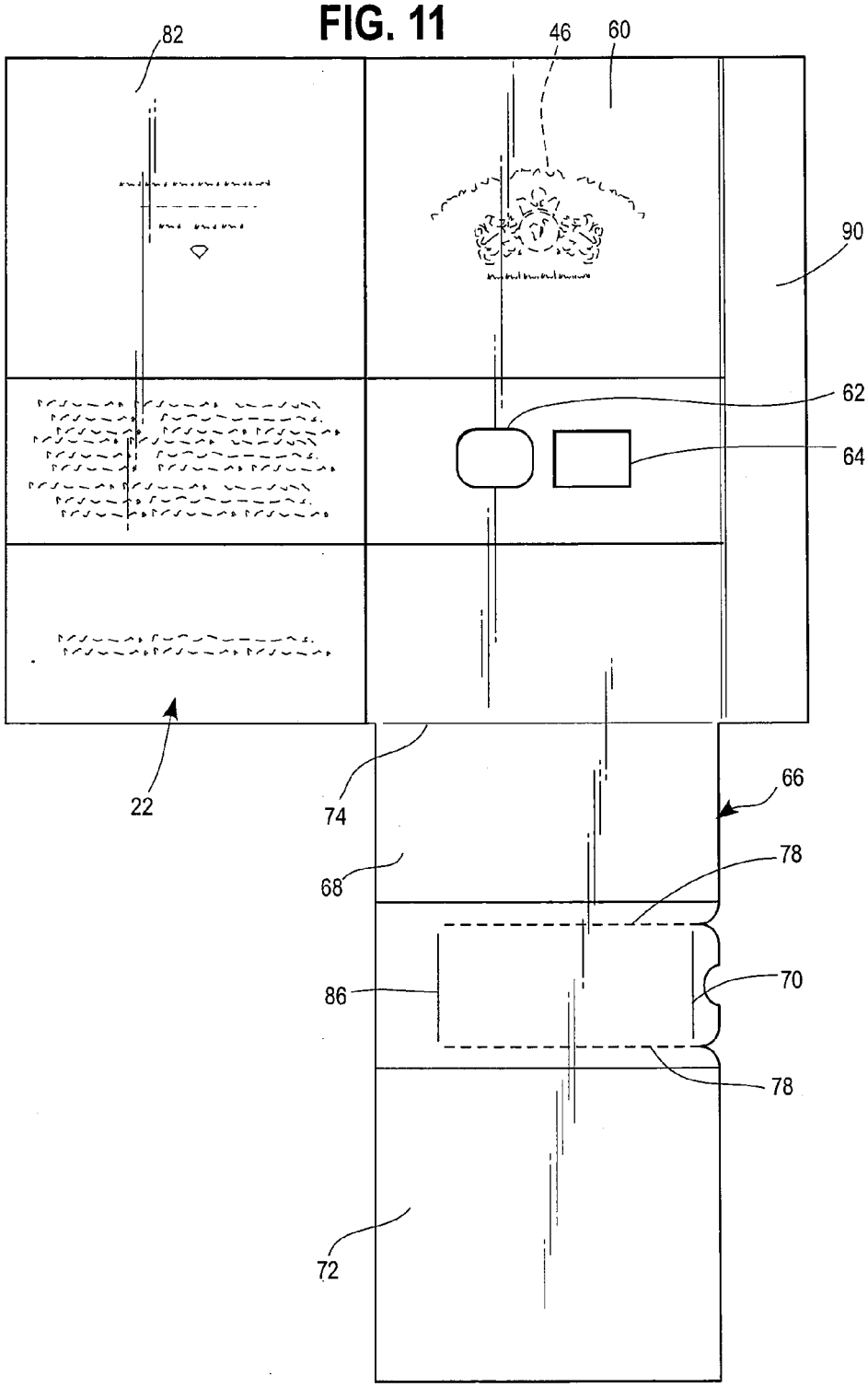

During use, the sealed diamond security case 24 is enclosed within security display carton 22 by inserting the security case 24 into the compartment 80 so that capsule 36 fits through opening 62 and capsule 38 fits through opening 64. The fold-out panel system 66 is folded up at fold line 74 and sealed to the front panel of the fold-open cover 60 with adhesive the sections 76 as shown in FIG. 9. In this position, the second section 70 may be removed if it is required to access the sealed diamond security case 24 by tearing along the perforated sections 78 and folding back the second section 70 along fold line 86.

Figure 7:
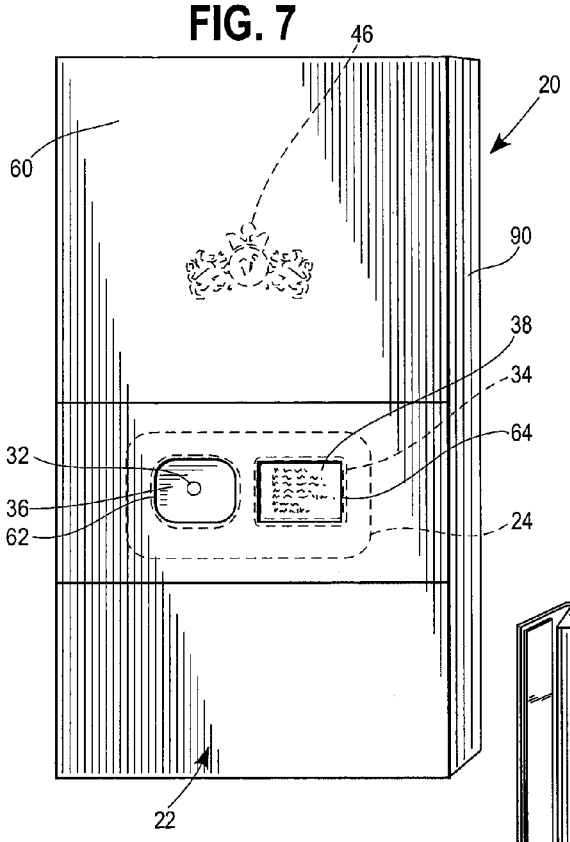
FIGS. 7 and 8 are front and back plan views of a display carton in a closed position for the diamond security case of FIGS. 1 and 2 and the informational materials of FIGS. 3A-6B.
Figure 8:
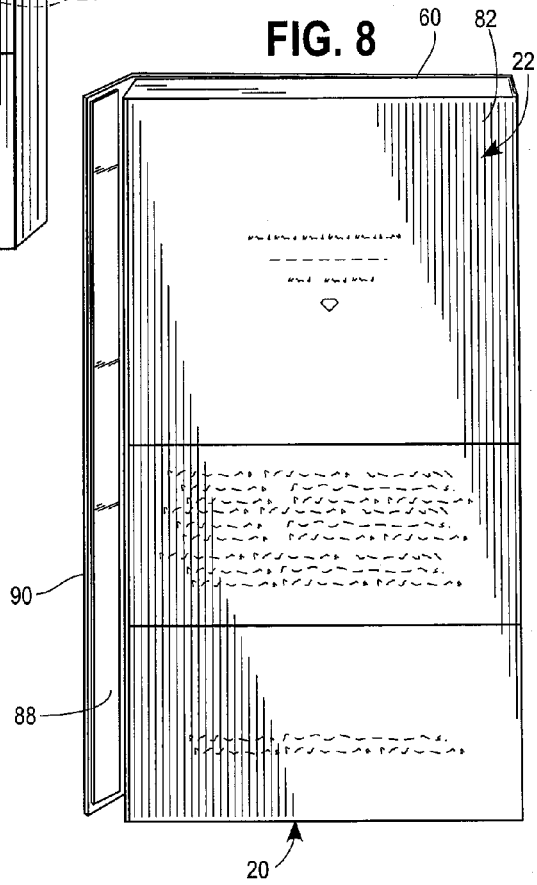

During a display for a potential purchasing or shipping situation, the registry wallet 48, including its contents, the CD-Rom 52 and the registry card 50, the GIA diamond grading report 58, and the owner's manual 44, are stored within the storage area 84. After the security case 32 and all other items are stored within the security display carton 22 as described, a removable cover (not shown) over adhesive backing 88 is removed from flap portion 90 along the edge of the fold-open cover 60, and the fold-open cover 60 is preferably sealed along the side of the container body 82 so that the configuration is sealed shut substantially as shown in FIG. 7. In this state, the diamond 32 is visible through the opening 62, and the printed information on the abbreviated certificate of authenticity 34 is visible through the opening 64.

It is also anticipated that additional security features be packaged with the kit 20. One optional security feature includes a radio frequency identification (RFID) tag 92 that stores and can provide complete information about the diamond 32 to an RFID reading system without ever having to open the fold-open cover 60 after it has been sealed closed to the container body 82. In some instances, the RFID tag 92 also includes additional security information that, for example, identifies whether the security display carton 22 or the compartment 80 has been opened after having been closed or sealed in a manner known in the art.

According to one aspect, a method of offering a precious gem, such as a diamond, for sale to a purchaser is provided that allows the purchaser to purchase a precious gem with the certainty that the gem has certain characteristics as certified by a certifying authority without the intervention of a local retail jeweler. Thus, the method can make online, i.e., internet-based, jewel retail services more attractive for a purchaser by providing greater certainty that the purchaser is receiving the quality of gem for which he or she has paid and thereby alleviate the uncertainty of purchasing the gem without having to go through the local retailer. By overcoming the need for independent verification of the characteristics of the gem by a local jeweler, the present method and system allows for a more efficient delivery pipeline, from wholesaler to end consumer, by reducing the number of people needed for physical inspection and checking of authenticity. On the other side of the transaction, the method can allow the retailer to "brand" the gem by providing a packaging and display system that provides a platform for placing the brand on the gem itself and on the informative and display materials associated with each gem.

In a first step, a display package for the precious gem is provided, such as the kit 20. The display package includes the security carton 22, and carried within the security carton are the sealed security case 24 carrying the precious gem and the abbreviated certificate of authenticity for that precious gem, and additional information about the precious gem, such as the registry wallet 48, grading report 58, and owner's manual 44. The security carton has an interior, an enclosed compartment, one or more windows through a wall of the security carton into the enclosed compartment, a removable access panel through a wall of the security carton into the enclosed compartment, and a storage area in the security carton separate from the enclosed compartment. The sealed security case is secured within the enclosed compartment. Certification information about the precious gem is printed on the abbreviated certificate of authenticity, and the precious gem and the certification information are viewable through the sealed security case and the one or more windows. Preferably, the precious gem and the certification information have been sealed together into the security case by or under the authority of the certifying authority. The storage area has an access opening that is accessible without opening the enclosed compartment, and the additional information is disposed in the storage area. In one example, the windows are in an outer wall of the security carton, and the removable access panel extends through an inner wall of the security carton that is only accessible from an interior side of the security carton. The access panel is defined by one or more frangible borders, such as lines of perforations, which allow the access panel to be easily torn open and must be damaged in order to remove the sealed security case therefrom.

After providing the display package, the gem and the certification information within the sealed security case are displayed to the purchaser through the one or more windows. At this same time, the purchaser may be provided access to the additional information while the sealed security case is secured within the enclosed compartment the enclosed within the display package, if, for example, the purchaser is viewing the display package in person at a physical retail location.

Based on the display of the gem and the certification information, the retailer offers to sell the gem to the purchaser based thereon without unsealing the sealed security case. Preferably, the offer for sale is accepted without removing the sealed security case from the enclosed compartment.

In one method, the displaying step and the offering step may be actuated via an internet platform, such as at a retail jewel purchasing web site, and the purchaser is an end consumer, whereby the method avoids interaction between the end consumer and a third-party local jeweler.

The certification information includes an identification number inscribed on the diamond, date of certification, shape, carat weight, color, and/or clarity information about the gem. Preferably, the certification information is provided by a recognized certifying authority, and the precious gem has been sealed with the abbreviated certificate of authenticity by or at the direction of the recognized certifying authority. The additional information can include an owner's manual, a registry card for the precious gem, and/or a grading report for the precious gem.

A source identification mark, such as a trademark of the retailer that is offering the gem for sale to the consumer, is inscribed on the precious gem, and the source identification mark is displayed on the security carton, the additional information materials, and/or the abbreviated certificate of authenticity.

According to another aspect, another method of packaging a precious gem, such as a diamond, is contemplated that also achieves some or all of the benefits of the invention. In this method, a first step is to have one or more identifiable characteristics about the precious gem certified as true, preferably by a recognized certification authority as described elsewhere herein. Thereafter, the precious gem and a certificate that identifies the characteristic about that precious gem are enclosed together within the sealed security case 24, wherein the precious gem and the certificate are viewable through the sealed security case. The sealed security case and additional information regarding the precious gem are enclosed together within a tamper-evident compartment within the display container 22, wherein the precious gem and the certificate are visible outside of the display container and the additional information is accessible for viewing while the sealed security case is enclosed in the tamper-evident compartment.

A container for facilitating the methods and system of the invention includes a display package, such as kit 20, for a precious gem including the security carton 22, the sealed security case 24 secured within sealed security carton, and additional information about the precious gem, such as the registry wallet 48, grading report 58, and owner's manual 44.

The security carton 22 has a left panel and a right panel that are joined together at a central fold line such that the left and right panels fold open and shut like a book to form an interior in the shut position and to expose the interior when folded open. The left panel has an enclosed compartment between an inner wall and the outer wall that is formed by folding up the inner wall against the outer wall of the left panel and being sealed thereto by, for example, adhesive strips. Windows are located through the outer wall of the left panel that open into the enclosed compartment. A removable access panel formed in the inner wall of the left panel provides tamper-evident access into the enclosed compartment from the interior of the sealed security carton, such as by a tear-back section of the inner wall defined partly by a frangible border encircling the enclosed compartment. A storage area is formed in the security carton separate from the enclosed compartment, such as by a recess formed in an interior side of the right panel.

A sealed security case, such as the sealed security case 24 including the precious gem and the abbreviated certificate of authenticity for the precious gem sealed therein, is secured within the enclosed compartment. The precious gem and certifying information about the precious gem are printed on a abbreviated certificate of authenticity and are visible from the outside of the security carton through the windows without having to open the security carton, remove the sealed security case from the enclosed compartment, or open the sealed security case. Further, the additional information about the precious gem disposed in the storage area can be viewed without removing the sealed security case from the enclosed compartment, or opening the sealed security case.

A sealed security case, such as the sealed security case 24 including the precious gem and the abbreviated certificate of authenticity for the precious gem are sealed therein, is secured within the enclosed compartment. The precious gem and certifying information about the precious gem printed on a abbreviated certificate of authenticity are visible from the outside of the security carton through the windows without having to open the security carton, remove the sealed security case from the enclosed compartment, or open the sealed security case. Further, the additional information about the precious gem disposed in the storage area can be viewed without removing the sealed security case from the enclosed compartment, or opening the sealed security case.

The left and right panels may be sealed shut in a folded closed position by any convenient means so as to prevent tampering with or loss of the additional information and/or as an additional tamper evident security measure to prevent access to the precious gem.

Specific embodiments of novel methods and apparatus for construction of diamond authentication, security, marketing display kit, and method according to the present invention have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

In some aspects, the current invention makes it easier for men or women to give a diamond as a gift. For many, preparing to give diamond jewelry as a gift can be quite daunting because the setting and the education all takes a lot of time and energy to research and understand. This along with the promise of a better value has spurred an increasing number to shop on-line, but both diamond and certificate are susceptible to imitation, making it quite risky for shoppers to venture out on their own. For jewelers, the diamond business presently requires too much inventory, too many sales staff, and too much miscellaneous overhead for every sale generated. The method and system disclosed herein addresses some or all of these issues, simply and effectively. Merchants who choose to incorporate this kit and method selling strategy can reasonably expect multiple benefits, such as, for example, the following:

1. More sales opportunities and new customers;
2. A faster sales cycle and lower sales costs;
3. Enhanced security features that will attract more on-line customers; and
4. Improved inventory control and additional benefits.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved. All patents, patent applications, and other printed publications identified in this foregoing are incorporated by reference in their entireties herein.

I claim:

1. A method of packaging a precious gem, the method comprising the steps of:

having a certain characteristic about the precious gem certified as true;

having the precious gem and a certificate that identifies the certain characteristic enclosed together within a sealed security case, wherein the precious gem and the certificate are viewable through the sealed security case;

positioning the sealed security case in a tamper-evident compartment within a display container having one or more windows through a wall of the display container;

moving an access panel of the tamper-evident compartment to enclose the sealed security case within the tamper-evident compartment; and enclosing the sealed security case that is enclosed within the tamper-evident compartment and additional information regarding the precious gem together within the display container such that the sealed security case and the additional information are both enclosed within an interior of the display container;

viewing the precious gem and the certificate through the one or more windows of the display container; and viewing the additional information while the sealed security case is enclosed in the tamper-evident compartment.

2. The method of claim 1, wherein the display container further comprises a storage area separate from the tamper-evident compartment, wherein the storage area has an access opening that is accessible without opening the tamper-evident compartment.

3. The method of claim 2, wherein the additional information about the precious gem is disposed in the storage area.

4. The method of claim 2, further comprising the step of displaying to a purchaser the gem and the certification information within the tamper-evident compartment through the one or more windows.

5. The method of claim 4, further comprising the step of offering to sell the precious gem within the sealed security case via an internet platform.

6. The method of claim 1, further comprising the step of offering to sell the gem to a purchaser without unsealing the sealed security case.

7. The method of claim 6, wherein the step of offering is performed without removing the sealed security case from the tamper-evident compartment.

8. The method of claim 6, wherein the offering step is performed via an internet platform.

9. The method of claim 6, wherein the purchaser is an end consumer, and further comprising the step of selling the gem to the end consumer without interaction of a third-party jeweler.

10. The method of claim 1, wherein the certain characteristic is certified by or under the authority of a certifying authority.

11. The method of claim 10, wherein the sealed security case is sealed by or at the direction of the certifying authority.

12. The method of claim 1, wherein the precious gem is a diamond.

13. The method of claim 1, wherein the certain characteristic comprises at least one of an identification number inscribed on the diamond, date of certification, shape, carat weight, color, and clarity information about the gem.

14. The method of claim 1, wherein at least one of the windows is through an outer wall of the display container, and the access panel extends through an inner wall of the display container that is only accessible from an interior of the display container.

15. The method of claim 2, wherein the access panel must be damaged in order to remove the sealed security case therefrom.

16. The method of claim 15, wherein the access panel is defined by one or more frangible borders that allow the access panel to be easily torn open.

17. The method of claim 16, wherein the frangible borders comprise one or more lines of perforations.

18. The method of claim 1, wherein the additional information comprises one or more of an owner's manual, a registry card for the precious gem, and a complete grading report for the precious gem.

19. The method of claim 1, further comprising a source identification mark inscribed on the precious gem, and further comprising the step of displaying the source identification mark on the display container.

* * * * *